US005984047A

United States Patent [19]

Rogers

[11] Patent Number: 5,984,047

[45] Date of Patent: Nov. 16, 1999

[54] ERECTABLE HORIZONTAL WORK SURFACE APPARATUS

[76] Inventor: William R. Rogers, 121 Kingsley Dr., Maulding, S.C. 29662

[21] Appl. No.: 09/135,913

[22] Filed: Aug. 18, 1998

Related U.S. Application Data

[63] Continuation-in-part of application No. 60/056,356, Aug. 18, 1997.

[51] Int. Cl.[6] ..... A47B 3/00

[52] U.S. Cl. ..... 182/153; 182/181; 248/439; 108/132

[58] Field of Search ..... 182/153, 152, 182/155, 181; 108/132; 248/439

[56] References Cited

U.S. PATENT DOCUMENTS

| | | | |
|---|---|---|---|
| 159,227 | 1/1875 | Sinclair . | |
| 1,585,598 | 5/1926 | Miner . | |
| 2,478,502 | 8/1949 | Peterson . | |
| 3,008,535 | 11/1961 | De Vries | 182/151 |
| 3,110,360 | 11/1963 | Hearn | 182/155 |
| 3,637,045 | 1/1972 | Poffenbaugh et al. | 182/155 |
| 4,030,565 | 6/1977 | Chaput | 182/151 |
| 4,191,111 | 3/1980 | Emmert . | |
| 4,296,834 | 10/1981 | Kroger | 182/155 |
| 4,771,863 | 9/1988 | Stansberry | 182/155 |
| 5,257,829 | 11/1993 | Weeks | 182/181 |

*Primary Examiner*—Alvin Chin-Shue
*Attorney, Agent, or Firm*—Hardaway/Mann IP Group

[57] ABSTRACT

An erectable horizontal work surface apparatus having a work surface pivotally connected to two sets of legs and removably connected to brace members for the sets of legs. The brace members are removably connected to the legs. When in the assembled position, the legs are extended at an angle somewhat perpendicular to the work surface and one end of the brace members are placed in brace member reception notches so as to connect the brace members to the legs. The opposite end of the brace members are connected to the work surface by use of a removable dowel member. To place the apparatus in a disassembled position, such as for transporting or storage, the dowel member is removed from its reception notch thus allowing the brace members to fall free. The legs are then pivoted toward the work surface until they are placed in a position that is parallel or horizontal with the work surface. The dowel reception channels in each brace member is then lined up with the dowel reception notch and the dowel is then placed in through the dowel reception notch as well as both dowel reception channels, hence locking the brace members and legs into place. The work surface has two grip channels one so the work surface can be gripped in an upright position, the other so the work surface can be placed in a cross-wise position, either for storing or moving the apparatus as a whole.

8 Claims, 3 Drawing Sheets

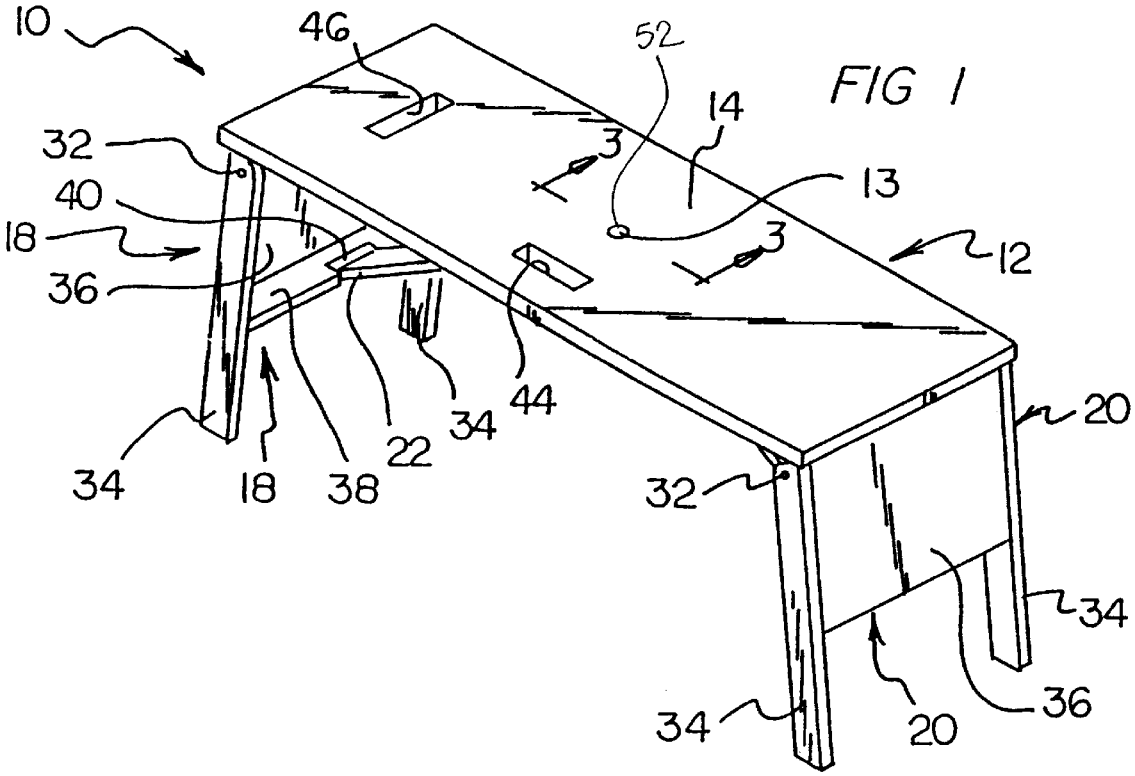
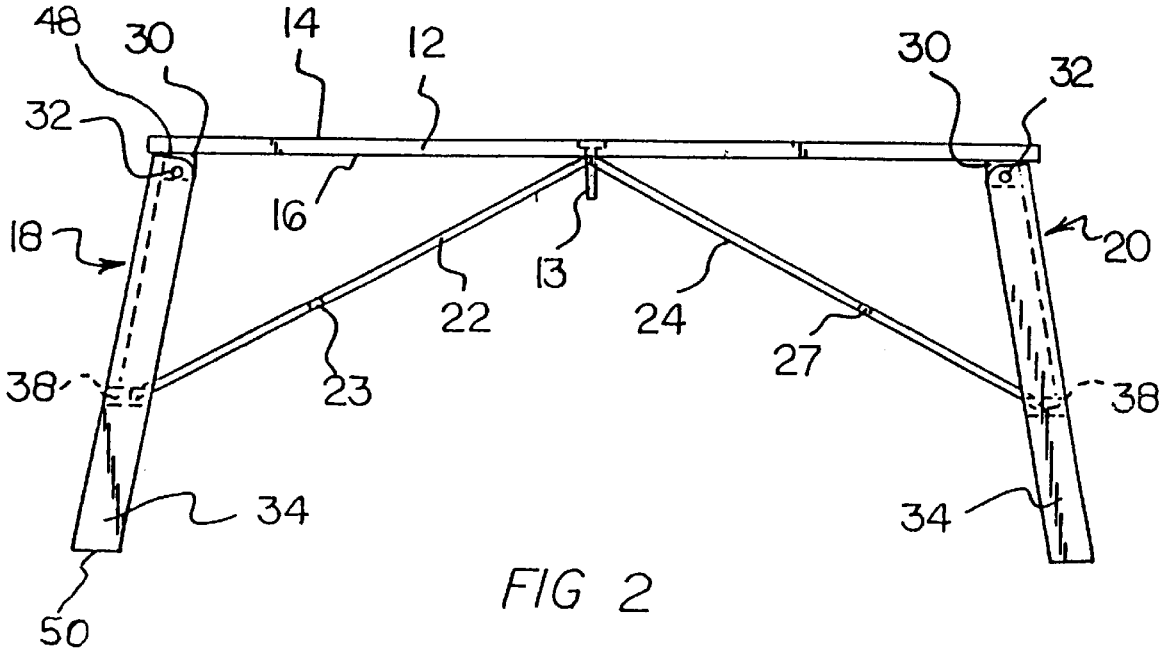
FIG 2

FIG 3
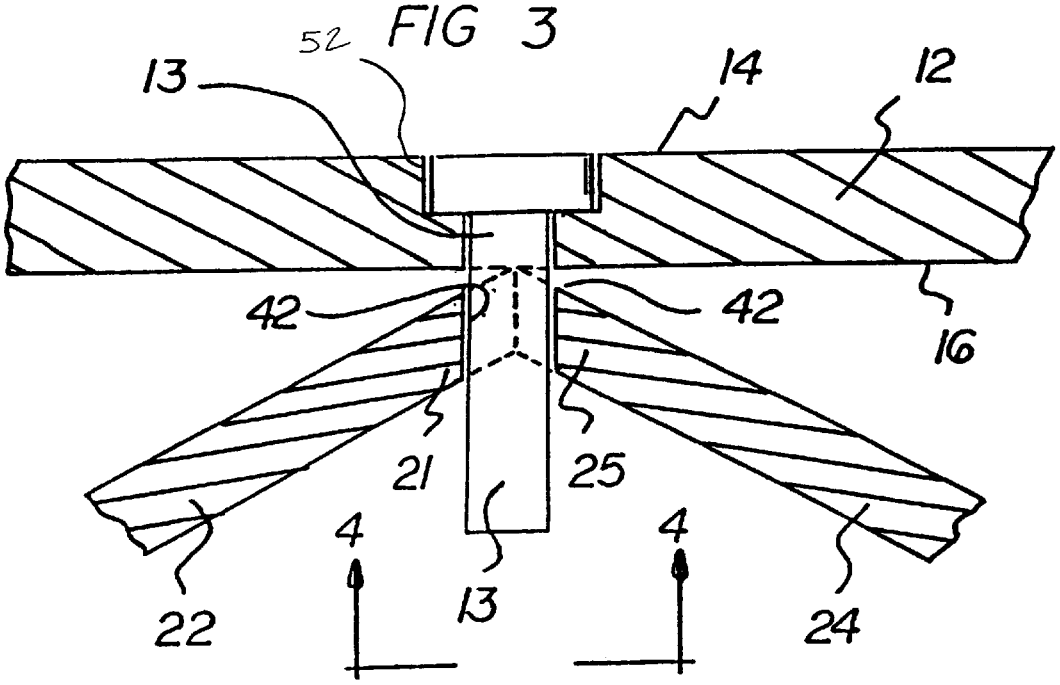
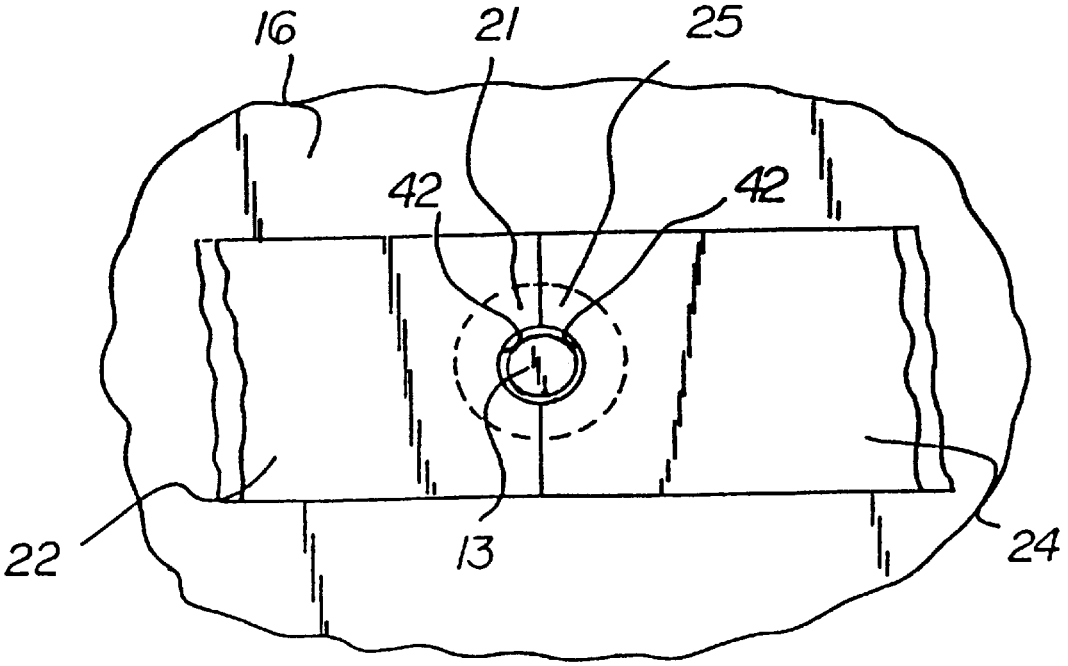
FIG. 4

ERECTABLE HORIZONTAL WORK SURFACE APPARATUS

This application is a Continuation-in-part of application Ser. No. 60/056,356, filed Aug. 18, 1997 and which is incorporated herein by reference.

BACKGROUND OF THE INVENTION

The present invention relates to a portable work surface which can be assembled for use and unassembled for storage and transport.

The field of portable work surfaces, also sometimes referred to as sawhorses, is well known as evidenced by the following patents issued to Poffenbaugh et al., Kroger, Weeks, Stansberry, De Vries, Chaput and Hearn. However, none of the current patents issued for portable work surfaces are as easily erectable or broken down for transportation as the current invention. The present invention can easily be used for standing or sitting on, allowing a person using it to freely move about such as is required when painting or performing home repairs. The work support member is of a size much larger that what is known in the art of saw horses, for example, it can even be at least as wide as over half the height of the leg members.

The Poffenbaugh et al. patent discloses a knockdown sawhorse with hinged legs and brackets which are pivotally connected to the bottom of the work surface. In the Poffenbaugh et al. patent, the legs fold up against the work surface and the brackets can be disconnected so as to lie flat against the work surface also, but this patent differentiates from the claimed invention because the connections must be screwed and unscrewed which make for a more lengthy assembling process, as well as when in the disassembled form, the legs protrude out from the work surface hence being easily caught on various things when being hauled. Also, there is no handle element to aid in the transporting of the sawhorse when not in use.

The Kroger patent shows a folding sawhorse that is also collapsible with the braces for the legs being pivotally mounted to the legs with a bearing rod, hence when broken down, the brace remains attached to the legs unlike the presently claimed invention. Also, with the Kroger patent, the legs protrude beyond the outer edges of the work surface making it prone to catching or snagging the legs as the sawhorse is being moved.

The Weeks patent is directed to a sawhorse that wherein the legs are completely removably attached to the work surface, and the brace members are pivotally mounted to the legs but can be removed if necessary. Also, the work surface in the Weeks patent is narrow and totally removed from the rest of the sawhorse when compacted down for transporting and storage.

The Stansberry patent discusses a saw horse construction wherein the brace members are connected to the work surface at separate places and are connected to the legs through the use of chain connections. The work surface in the Stansberry patent is limited in size and does not offer a large surface upon which to work as it is long and narrow. Also, the rod used for support is attached to the work surface with a rivet.

The De Vries patent discloses a sawhorse assembly having a narrow work surface that is removably attached to the legs with bolts. Tie rods are used for support brackets and they too are connected to the work surface with a bolt. The tie rods are also connected to the legs with a slidably mounted crosspiece. Again, in order to break down this sawhorse for storage and transporting requires a significant amount of effort for the bolts as well as sliding off and unhooking the support crosspieces and tie rods.

The Chaput patent describes a collapsible sawhorse package which actually has a handle in place for ease in carrying. In the Chaput invention, once in the folded position, the work surface is no longer accessible for use as in the presently claimed invention. Also, the work surface is long and narrow, limiting its use. The legs in the Chaput invention have rods that are used to brace the legs to one another and no brace or bracket from the legs to the work surface.

The Hearn patent discloses a sawhorse that is primarily comprised of tubular elements with the connections being bolts. In Hearn, the work surface is tubular making it difficult to lay things on the work surface without them sliding off and the work surface is long and narrow as in the other patents as well. The brace assemblies are pivotally mounted by using bolts both at the connections to the legs as well as the connection to the work surface. With bolt assemblies, much more effort is needed to assemble and disassemble the sawhorse than in the presently claimed invention.

SUMMARY OF THE INVENTION

An erectable horizontal work surface apparatus includes a work support member which includes a top work surface and a bottom surface. A dowel member is connected to the work support member. The dowel member extends downward from the bottom surface of the work support member. A first foldable leg assembly is connected to a first end of the work support member and can be selectively positioned in either an erected position or a folded position with respect to the work support member. A second foldable leg assembly is connected to a second end of the work support member. The second foldable leg assembly can be selectively positioned in either an erected position or a folded position with respect to the work support member. A first brace member includes a dowel contact end and a dowel reception channel. The first brace member is selectively installed between the first foldable leg assembly and the dowel member when the first foldable leg assembly is in the erected position. Alternatively, the first brace member is selectively connected to the dowel member and positioned between the first foldable leg assembly and the second foldable leg assembly when the first foldable leg assembly and the second foldable leg assembly are in a folded position. A second brace member includes a dowel contact end and a dowel reception channel. The second brace member is selectively installed between the second foldable leg assembly and the dowel member when the second foldable leg assembly is in the erected position. Alternatively, the second brace member is selectively connected to the dowel member and positioned between the first foldable leg assembly and the second foldable leg assembly when the first foldable leg assembly and the second foldable leg assembly are in a folded position. A top portion of the dowel member is coplanar with the top work surface of the work support member. With the erectable horizontal work surface apparatus of the invention, the apparatus can readily be transformed from an erected position to a folded position and vice versa.

Each of the first foldable leg assembly and the second foldable leg assembly includes a support block connected to the work support member. A pair of pivots are connected to opposite ends of the support block. A pair of leg members are connected to the respective pivots, and a transverse leg brace is connected between each pair of leg members. A cover panel is supported by the leg members and transverse leg brace. Each of the transverse leg braces includes a brace member or the second brace member. In addition, each of the first brace member and the second brace member includes a dowel reception notch for engaging the dowel member. Also, the work support member includes a longitudinally oriented first grip channel and a transversely oriented second grip channel.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the erectable horizontal work surface apparatus of the invention in an erected position.

FIG. 2 is a side elevational view of the embodiment of the erectable horizontal work surface apparatus shown in FIG. 1.

FIG. 3 is an enlarged, partial cross-sectional view of the embodiment of the erectable horizontal work surface apparatus in FIG. 1 taken along line 3—3 thereof.

FIG. 4 is a bottom view of the portion of the embodiment of the invention shown in FIG. 3 taken along line 4—4 thereof.

DESCRIPTION OF THE PREFERRED EMBODIMENT

Figure 5:
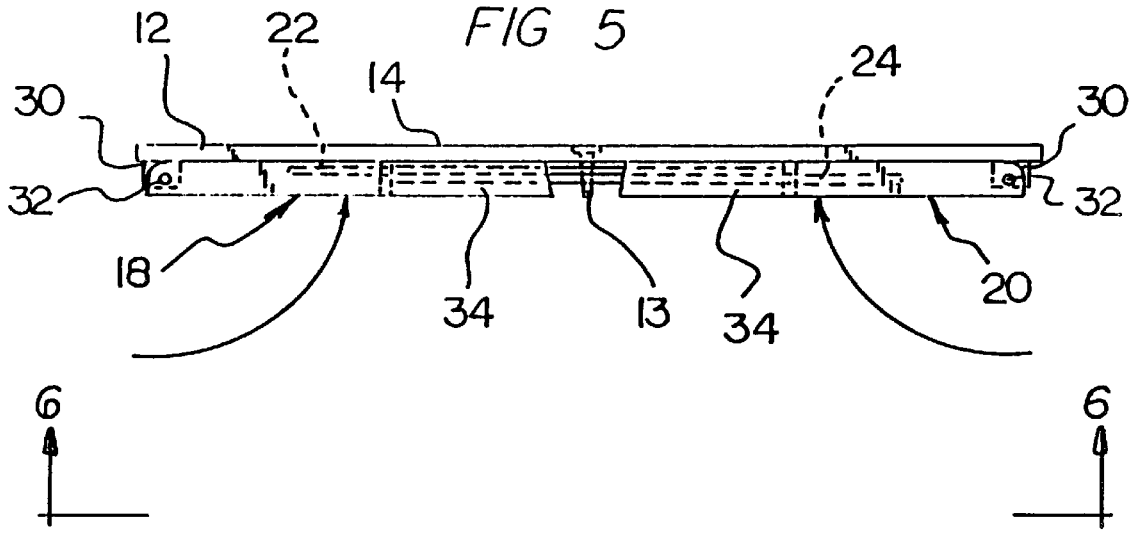
FIG. 5 is a side elevational view of the embodiment of the invention shown in FIG. 2 in a folded position.

With reference to the drawings, a new and improved erectable horizontal work surface apparatus embodying the principles and concepts of the present invention will be described.

Turning to FIGS. 1–6, there is shown an exemplary embodiment of the erectable horizontal work surface apparatus of the invention generally designated by reference numeral 10. In its preferred form, erectable horizontal work surface apparatus 10 includes a work support member 12 which includes a top work surface 14 and a bottom surface 16. A dowel member 13 extends downward from the bottom surface 16 of the work support member 12. A first foldable leg assembly 18 is connected to a first end of the work support member 12. The first foldable leg assembly 18 can be selectively positioned in either an erected position or a folded position with respect to the work support member 12. A second foldable leg assembly 20 is connected to a second end of the work support member 12. The second foldable leg assembly 20 can be selectively positioned in either an erected position or a folded position with respect to the work support member 12. A first brace member 22 includes a dowel contact end 21 and a dowel reception channel 23. The first brace member 22 is selectively installed between the first foldable leg assembly 18 and the dowel member 13 when the first foldable leg assembly 18 is in the erected position. Alternatively, the first brace member 22 is selectively connected to the dowel member 13 and positioned between the first foldable leg assembly 18 and the second foldable leg assembly 20 when the first foldable leg assembly 18 and the second foldable leg assembly 20 when the first foldable leg assembly 18 and the second foldable leg assembly 20 are in a folded position. A second brace member 24 includes a dowel contact end 25 and a dowel reception channel 27. The second brace member 24 is selectively installed between the second foldable leg assembly 20 and the dowel member 13 when the second foldable leg assembly 20 is in the erected position. Alternatively, the second brace member 24 is selectively connected to the dowel member 13 and positioned between the first foldable leg assembly 18 and the second foldable leg assembly 20 when the first foldable leg assembly 18 and the second foldable leg assembly 20 are in a folded position. A top portion of the dowel member 13 is coplanar with the top work surface 14 of the work support member 12.

Each of the first foldable leg assembly 18 and the second foldable leg assembly 20 includes a support block 30 connected to the bottom surface 16 of the work support member 12. A pair of pivots 32 are connected to opposite ends of the support block 30. A pair of leg members 34 are connected to the respective pivots 32, and a transverse leg brace 38 is connected between each pair of leg members 34. A cover panel 36 is supported by the leg members 34 and the transverse leg brace 38. Each of the transverse leg braces 38 includes a brace member reception notch 40 for being pivotally connected with an end of the respective first brace member 22 or the second brace member 24. In addition, each of the first brace member 22 and the second brace member 24 includes a dowel reception notch 42 for engaging the dowel member 13. Also, the work support member 12 includes a longitudinally oriented first grip channel 44 and a transversely oriented second grip channel 46.

To use the erectable horizontal work surface apparatus 10 in the erected position, such as shown in FIGS. 1–3, the leg members 34 of the first foldable leg assembly 18 and the second foldable leg assembly 20 are swung around the respective pivots 32. The top ends 48 of the leg assemblies are then in contact with the bottom surface 16 of the work support member 12. The bottom ends 50 of the leg assemblies are set on a support surface such as a floor or the bed of a truck. In this way, the work support member 12 serves as a stop member for rotation of the respective leg members 34 around the respective pivots 32. Then, the first brace member 22 and the second brace member 24 are installed. That is, the dowel reception notches 42 are placed in engagement with the dowel member 13, and the opposites ends of the first brace member 22 and the second brace member 24 are pivotally connected with the brace member reception notches 40 of the transverse leg brace 38. In the erect position, items that are worked on and tools can be placed on the top work surface 14 of the work support member 12.

Figure 6:
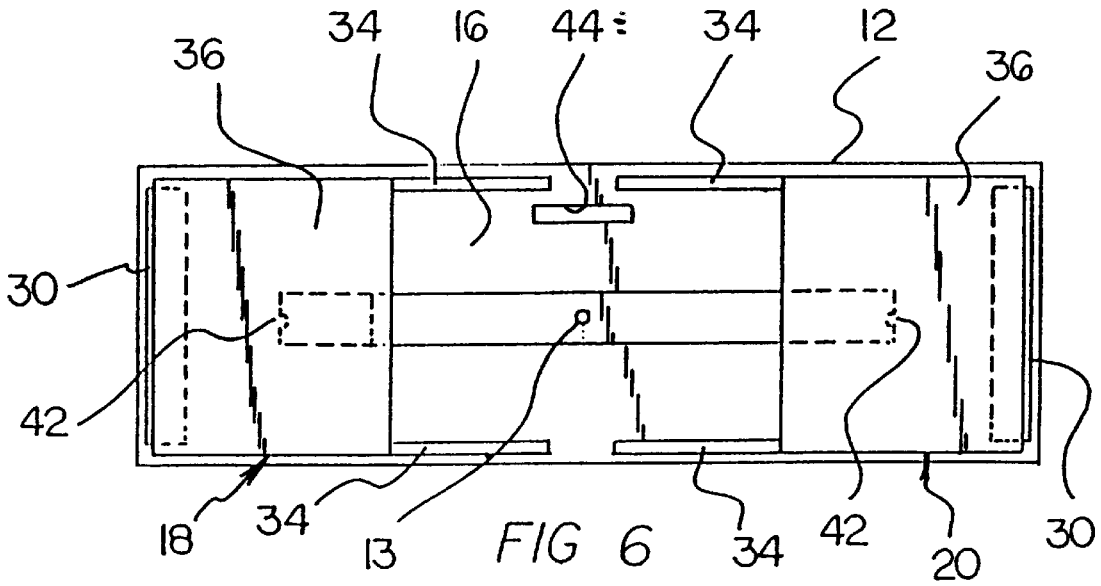
FIG. 6 is a bottom view of the folded embodiment of the invention shown in FIG. 5 taken along line 6—6 thereof.

When the erectable horizontal work surface apparatus 10 is ready for storage, the apparatus is converted into the folded position such as shown in FIGS. 4–6. More specifically, the first brace member 22 and the second brace member 24 are disengaged from the dowel member 13 and the respective transverse leg braces 38. Then, the work support member 12 is placed on a support surface, such as a floor, with the bottom portion of the dowel member 13 accessible. Then, the dowel reception channel 23 of the first brace member 22 is placed in registration with the opening 52 for the dowel member 13. Similarly, the dowel reception channel 27 of the second brace member 24 is placed in registration with the opening 52 for the dowel member 13, and then the dowel member 13 is installed in the opening 52 for the dowel member 13 and the dowel reception channel 23 of the first brace member 22 and the dowel reception channel 27 of the second brace member 24. Once both the first brace member 22 and the second brace member 24 are installed on the dowel member 13, the leg members 34 of the first foldable leg assembly 18 and the second foldable leg assembly 20 are swung around the respective pivots 32 in the direction of the dowel member 13 so that the top end 48 of each leg assembly is in a position perpendicular to said work support member. When this occurs, the erectable horizontal work surface apparatus 10 of the invention is in the folded position. Either the first grip channel 44 or the second grip channel 46 can be used for carrying the folded apparatus.

To use the erectable horizontal work surface apparatus 10 in an erected position again, the leg members 34 are rotated around the respective pivots 32, the first brace member 22 and the second brace member 24 are removed from the dowel member 13, and the first brace member 22 and the second brace member 24 are reinstalled as described above.

The components of the erectable horizontal work surface apparatus of the invention can be made from inexpensive and durable metal, wooden, plastic or any other suitable or like materials.

The foregoing detailed description is considered as illustrative only of the principles of the invention. Numerous modifications and changes will readily occur to those skilled in the art and therefore, it is not desired to the limit the invention to the exact construction and operation shown and described. Accordingly, all suitable modifications and equivalents falling within the broad scope of the subject matter described above may be resorted to in carrying out the present invention.

What is claimed is:

1. An erectable horizontal work surface apparatus comprising:

a work support member having a top work surface, said work support member having a vertically extending opening therethrough and a bottom work surface;

a dowel member removably connected to said work support member, said dowel member been vertically inserted into said opening; wherein a top portion of said dowel member is coplanar with said top work surface of said work support member;

a first support block attached to said bottom work surface of said work support member;

a first leg assembly connected to said first support block at a first end to said work support member;

a second support block attached to said bottom work surface of said work support member;

a second leg assembly connected to said second support block at a second end to said work support member;

a first brace member having a dowel contact end for connecting said dowel with said first brace member when said horizontal work surface apparatus is in an erected position and a dowel reception channel for connecting said dowel member with said first brace member when said horizontal work surface apparatus is in a folded position, said first brace member being removably connected to said dowel member; and a second brace member having a dowel contact end for connecting said dowel with said second brace member when said horizontal work surface apparatus is in an erected position and a dowel reception channel for connecting said dowel member with said second brace member when said horizontal work surface apparatus is in a folded position, said second brace member being removably connected to said dowel member; and a top end of said first leg assembly and a top end of said second leg assembly are in contact with said work support member;

wherein said horizontal work surface apparatus is assembled in an erect position.

2. The erectable horizontal work surface apparatus of claim 1, wherein:

said first leg assembly being comprised of a first leg and a second leg, a first transverse leg brace located between and attached to said first leg and said second leg, said first transverse leg brace having a first brace member reception notch for connecting said first leg assembly with said first brace member;

said second leg assembly being comprised of a third leg and a fourth leg, a second transverse brace located between and attached to said third leg and said fourth leg, said second transverse leg brace having a second brace member reception notch for connecting said second leg assembly with said second brace member;

said first brace member is removably connected to said dowel member at said dowel contact end;

said second brace member is removably connected to said dowel member at said dowel contact end;

said first leg assembly is pivotally connected to said first support block; and said second leg assembly is pivotally connected to said second support block.

3. The erectable horizontal work surface of claim 2, wherein:

an end of said first brace member is connected to said first brace member reception notch; and an end of said second brace member is connected to said second brace member reception notch.

4. The erectable horizontal work surface of claim 3, wherein:

said horizontal work surface has at least one handle.

5. An erectable horizontal work surface apparatus comprising:

a work support member having a top work surface, said work support member having a vertically extending opening therethrough and a bottom work surface;

a dowel member removably connected to said work support member, said dowel member been vertically inserted into said opening; wherein a top portion of said dowel member is coplanar with said top work surface of said work support member;

a first support block attached to said bottom work surface of said work support member;

a first leg assembly connected to said first support block at a first end to said work support member;

a second support block attached to said bottom work surface of said work support member;

a second leg assembly connected to said second support block at a second end to said work support member;

a first brace member having a dowel contact end for connecting said dowel with said first brace member when said horizontal work surface apparatus is in an erected position and a dowel reception channel for connecting said dowel member with said first brace member when said horizontal work surface apparatus is in a folded position, said first brace member being removably connected to said dowel member; and a second brace member having a dowel contact end for connecting said dowel with said second brace member when said horizontal work surface apparatus is in an erected position and a dowel reception channel for connecting said dowel member with said second brace member when said horizontal work surface apparatus is in a folded position, said second brace member being removably connected to said dowel member; and a top end of said first leg assembly and a top end of said second leg assembly are in a position perpendicular with said work support member;

wherein said horizontal work surface apparatus is disassembled into a storage position.

6. The erectable horizontal work surface of claim 5, wherein:

said first leg assembly being comprised of a first leg and a second leg, a first transverse leg brace located between and attached to said first leg and said second leg, said first transverse leg brace having a first brace member reception notch for connecting said first leg assembly with said first brace member;

said second leg assembly being comprised of a third leg and a fourth leg, a second transverse brace located between and attached to said third leg and said fourth leg, said second transverse leg brace having a second brace member reception notch for connecting said second leg assembly with said second brace member;

said first brace member is removably connected to said dowel member at said dowel reception channel;

said second brace member is removably connected to said dowel member at said dowel reception channel;

said first leg assembly is pivotally connected to said first support block; and said second leg assembly is pivotally connected to said second support block.

7. The erectable horizontal work surface of claim 6, wherein:

said work support member has at least one handle therein.

8. A method for erecting a horizontal work surface comprised of the steps of:

providing for a work support member, said dowel member been vertically inserted into said opening having a top work surface, said work support member having a vertically extending opening therethrough and a bottom work surface, a dowel member removably connected to said work support member, a first support block attached to said bottom work surface of said work support member, a first leg assembly connected to said first support block at a first end to said work support member, a second support block attached to said bottom work surface of said work support member, a second leg assembly connected to said second support block at a second end to said work support member, a first brace member having a dowel contact end and a dowel reception channel, said first brace member being removably connected to said dowel member at said dowel reception channel, and a second brace member having a dowel contact end and a dowel reception channel, said second brace member being removably connected to said dowel member at said dowel reception channel, and a top end of said first leg assembly and a top end of said second leg assembly are in a position perpendicular with said work support member;

pivoting said first leg assembly around a pair of pivots, one pivot located in each end of said first support block, until said top end of said first leg assembly is in contact with said work support member, and said bottom end of said first leg assembly is resting on a support surface;

pivoting said second leg assembly around a pair of pivots, one pivot located in each end of said second support block, until said top end of said second leg assembly is in contact with said work support member, and said bottom end of said second leg assembly is resting on a support surface;

pivoting said first brace member until said dowel reception notch is in registration with an opening for said dowel member;

pivoting said second brace member until said dowel reception notch is in registration with said opening for said dowel member;

placing said dowel member in said opening for said dowel member and in contact with said contact end of said first brace member and said contact end of said second brace member; and placing said dowel such that the top portion of said dowel is coplanar with said top work surface.

* * * * *